US010519763B2

(12) United States Patent
Castrero et al.

(10) Patent No.: US 10,519,763 B2
(45) Date of Patent: Dec. 31, 2019

(54) SONDE HOUSING HAVING SIDE ACCESSIBLE SONDE COMPARTMENT

(71) Applicant: Eastern Driller Manufacturing Co., Inc., Columbia, PA (US)

(72) Inventors: Antonio Castrero, Lancaster, PA (US); Timothy Stump, Lancaster, PA (US)

(73) Assignee: EASTERN DRILLER MANUFACTURING CO., INC., Columbia, PA (US)

( * ) Notice: Subject to any disclaimer, the term of this patent is extended or adjusted under 35 U.S.C. 154(b) by 215 days.

(21) Appl. No.: 15/699,041

(22) Filed: Sep. 8, 2017

(65) Prior Publication Data

US 2019/0078431 A1 Mar. 14, 2019

(51) Int. Cl.

| | |
|---|---|
| ***E21B 47/01*** | (2012.01) |
| ***E21B 7/06*** | (2006.01) |
| ***E21B 10/36*** | (2006.01) |

(52) U.S. Cl.

CPC ..... *E21B 47/011* (2013.01); *E21B 7/067* (2013.01); *E21B 10/36* (2013.01)

(58) Field of Classification Search

CPC ..... E21B 47/011

See application file for complete search history.

(56) References Cited

U.S. PATENT DOCUMENTS

| | | | | |
|---|---|---|---|---|
| 2,937,619 | A | 5/1960 | Kurt | |
| 3,958,645 | A | 5/1976 | Curington | |
| 4,030,554 | A | 6/1977 | Kammerer, Jr. et al. | |
| 4,043,611 | A | 8/1977 | Wallace | |
| 4,084,646 | A | 4/1978 | Kurt | |
| 4,303,135 | A | 12/1981 | Benoit | |
| 4,530,408 | A | 7/1985 | Toutant | |
| 4,706,764 | A | 11/1987 | Hughes | |
| 4,821,812 | A | 4/1989 | Ditzig | |
| 5,301,758 | A | 4/1994 | Jenne | |
| 5,337,837 | A | 8/1994 | Wentworth et al. | |
| 5,465,797 | A | 11/1995 | Wentworth et al. | |
| 5,603,383 | A | 2/1997 | Wentworth et al. | |
| 5,680,904 | A | 10/1997 | Patterson | |
| 5,944,117 | A | 8/1999 | Burkholder et al. | |
| 6,386,301 | B1 | 5/2002 | Rear | |
| 6,422,782 | B1 * | 7/2002 | Wentworth | E21B 7/046 175/398 |
| 6,454,025 | B1 | 9/2002 | Runquist et al. | |
| 6,644,421 | B1 | 11/2003 | Long | |
| 7,036,609 | B2 * | 5/2006 | Michael | E21B 7/046 175/19 |
| 7,121,363 | B2 * | 10/2006 | Michael | E21B 7/046 175/45 |
| 7,172,035 | B2 * | 2/2007 | Michael | E21B 7/046 175/19 |
| 8,544,566 | B2 | 10/2013 | Mulligan | |

(Continued)

*Primary Examiner* — Brad Harcourt
*Assistant Examiner* — Steven A MacDonald
(74) *Attorney, Agent, or Firm* — Panitch Schwarze Belisario & Nadel LLP

(57) ABSTRACT

A sonde housing for a fluid-actuated percussive impact tool includes a sonde compartment formed in the sonde housing and defining an open side along an exterior side surface of the sonde housing. A sonde is removably secured in the sonde compartment, and a cover is removably mounted upon the open side of the sonde compartment to close the open side thereof.

12 Claims, 3 Drawing Sheets

(56) References Cited

U.S. PATENT DOCUMENTS

| | | | | |
|---|---|---|---|---|
| 8,939,237 | B2 * | 1/2015 | Runquist | E21B 7/046 175/398 |
| 8,955,586 | B1 * | 2/2015 | Randa | E21B 47/02224 166/250.11 |
| 9,453,372 | B2 | 9/2016 | Stump et al. | |
| 9,719,344 | B2 * | 8/2017 | Melsheimer | E21B 10/602 |
| 9,732,560 | B2 * | 8/2017 | Fontana | E21B 47/01 |
| 10,246,993 | B2 * | 4/2019 | Melsheimer | E21B 10/602 |
| 2003/0131992 | A1 * | 7/2003 | Michael | E21B 7/046 166/255.2 |
| 2004/0040751 | A1 | 3/2004 | Falvey et al. | |
| 2005/0205299 | A1 * | 9/2005 | Michael | E21B 7/046 175/45 |
| 2006/0151213 | A1 * | 7/2006 | Michael | E21B 7/046 175/40 |
| 2011/0303464 | A1 | 12/2011 | Mulligan | |

* cited by examiner

SONDE HOUSING HAVING SIDE ACCESSIBLE SONDE COMPARTMENT

BACKGROUND OF THE INVENTION

The present disclosure relates generally to impact tools for use in drilling operations, and more particularly, to fluid-actuated drilling equipment with a sonde housing having a side accessible sonde compartment.

Fluid-actuated directional percussive impact tools, such as drills, are commonly used for directional boring, which allows for the underground installation of pipes, cables, or the like without digging a trench. Drills for such operations typically include a back head for connection to a pressurized fluid source and a tool casing that houses a drill bit. A sonde housing having a sonde therein is typically arranged between the back head and the casing. The sonde can be used to register data, such as angle, rotation, or direction of the drill, temperature or the like. The data is then encoded into electro-magnetic signals and transmitted through the ground to the surface. At the surface a receiver is manually positioned over the sonde signals and the signals are decoded and steering directions relayed to the operator of the drill.

Typically a bent sub (a small, angled piece of the drill string), is used to connect the sonde housing to the tool casing. The angle of the bent sub allows the driller to steer the tool casing around obstacles that may be in the way of the planned route and/or to steer up or down to hit a set exit point of the drill.

Electronic components operating the drill, such as the sonde itself, are battery operated. Naturally, with use, the sonde battery is depleted and requires replacement. Typically, the battery is located within the sonde and the sonde is only accessible from the top of the sonde housing. Consequently, accessing the sonde battery requires disassembling the tool casing from the sonde housing to obtain the sonde. The sonde housing is typically threadedly attached to the tool casing and the prevailing method used in the industry to prevent loosening of the threaded connection during use is to weld or epoxy the joint together. Therefore, unthreading of the tool casing from the sonde housing requires heating and/or burning the threaded connection in order to untorque the tool casing from the sonde housing to access the sonde. After replacing the sonde battery and the sonde is re-inserted into the sonde housing, the threads must be re-applied with epoxy and the tool casing re-torqued onto the sonde housing and/or the tool casing is re-welded with the tool casing. This process is very inefficient and time consuming, taking anywhere from forty-five minutes to several hours to complete.

It is therefore desirable to provide a sonde housing with more direct access to the sonde in order to simplify and streamline the sonde battery replacement process.

BRIEF SUMMARY OF THE INVENTION

Briefly stated, one embodiment of the present invention is directed to a sonde housing for a fluid-actuated percussive impact tool. The sonde housing comprises a sonde compartment formed in the sonde housing and defining an open side along an exterior side surface of the sonde housing. A sonde is removably secured in the sonde compartment, and a cover is removably mounted upon the open side of the sonde compartment to close the open side thereof.

Another embodiment of the present invention is directed to a fluid-actuated percussive impact tool. The tool comprises a back head for connection to a pressurized fluid source and a tool casing housing a drill bit longitudinally movable with respect thereto. The drill bit defines a central axis extending longitudinally therethrough. A sonde housing is coupled between the back head and the tool casing and defines a central axis extending longitudinally through the sonde housing. The sonde housing comprises a sonde compartment formed in the sonde housing and defining an open side along an exterior side surface of the sonde housing. A sonde is removably secured in the sonde compartment, and a cover is removably mounted upon the open side of the sonde compartment to close the open side thereof. A bent sub is integrally formed with the sonde housing and connects the sonde housing to the tool casing, such that the central axis of the drill bit intersects the central axis of the sonde housing at a non-zero angle.

BRIEF DESCRIPTION OF THE DRAWINGS

The foregoing summary, as well as the following detailed description of a preferred embodiment of the invention, will be better understood when read in conjunction with the appended drawings. For the purpose of illustration, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
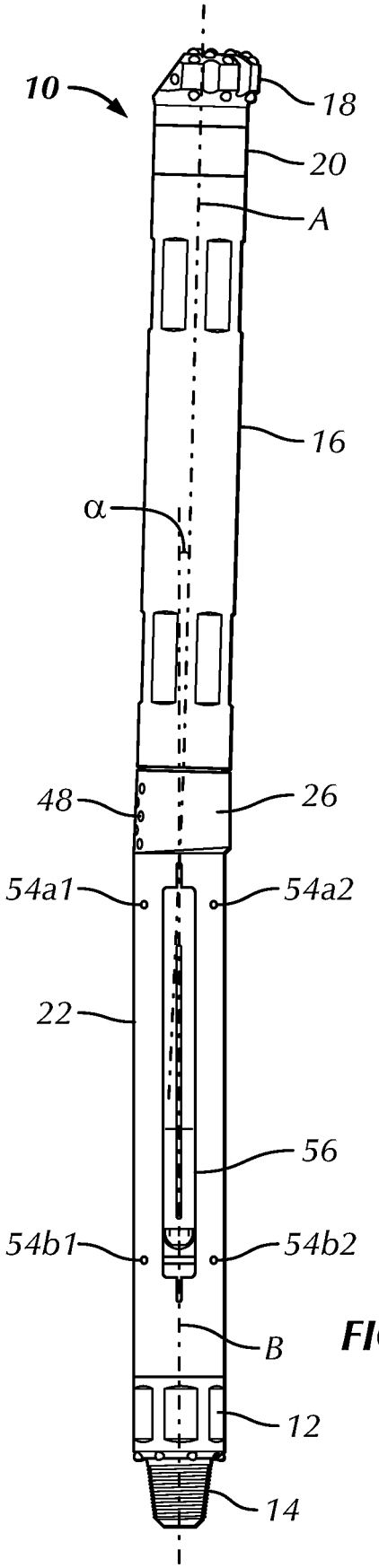
FIG. 1 is a right side elevational view of a fluid-actuated directional percussive impact tool in accordance with a preferred embodiment of the present invention.
Figure 2:
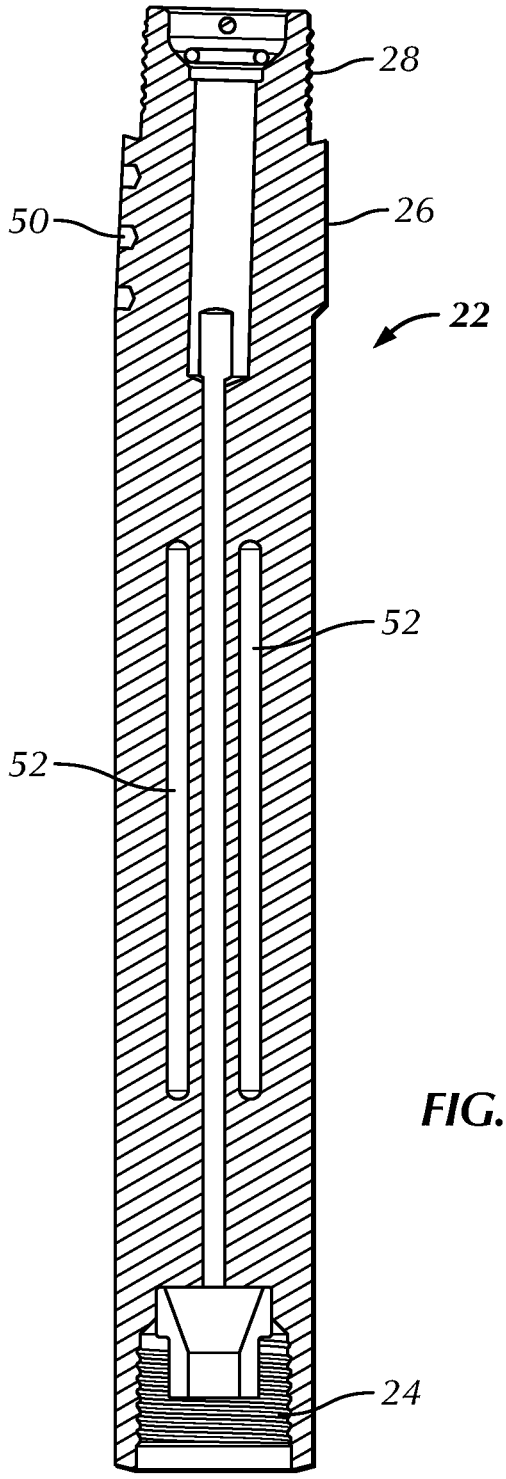
FIG. 2 is an enlarged right side elevational cross-sectional view of the sonde housing and bent sub of the fluid-actuated directional percussive impact tool of FIG. 1.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the fluid-actuated directional percussive impact tool and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings, wherein like numerals indicate like elements throughout, there is shown in FIGS. 1-4, a fluid-actuated directional percussive impact tool 10 adapted for directional drilling or boring. The tool or drill 10 is adapted to be placed in a bore in a ground surface (not shown) using an appropriate drill string (not shown). The drill 10 is provided with a back head 12, which couples the drill string to the remainder of the body of the drill 10. The back head 12 includes a mating threaded section 14 for connection to the drill string. A central channel (not shown) is provided through the back head 12 for passing pressurized fluid from the drill string to the remainder of the drill 10.

The drill 10 further includes a longitudinally extending casing 16. A first end of the casing 16 preferably includes a threaded section (not shown) to facilitate connection to other components of the drill 10 and receiving the fluid provided from the back head 12. An impact receiving device, such as a longitudinally extending percussive drill bit 18 is mounted at a second end of the casing 16. A first end of the drill bit 18 is disposed within the casing 16, and a second end of the drill bit 18 is disposed outside of the casing 16 for impacting the surface (not shown) to be drilled. The drill bit 18 and the casing 16 are longitudinally movable with respect to one another. The percussive drill bit 18 is coupled to the casing 16 by a supporting chuck 20. The supporting chuck 20 is threadedly and removably engaged with the casing 16 at the second end thereof using a thread or the like. The percussive drill bit 18 is mounted for restricted axial movement within the chuck 20. A piston (not shown) is preferably also disposed within the casing 16 and is longitudinally movable with respect thereto. The piston oscillates in accordance with the fluid delivery to impart a striking force to the drill bit 18.

A generally cylindrically shaped sonde housing 22 is coupled between the back head 12 and the casing 16. In the illustrated embodiment, the sonde housing 22 includes a threaded first end 24 (FIG. 2) for mating with a complimentary threaded section (not shown) of the back head 12. At a second, opposite end of the sonde housing 22 is a bent sub 26. The bent sub 26 connects the sonde housing 22 to the casing 16 via a threaded end 28.

In one embodiment, the bent sub 26 is integrally formed with the sonde housing 22, but the disclosure is not so limited. For example, the sonde housing 22 and bent sub 26 may be formed together from a single piece of turned steel. The sonde housing 22 and bent sub 26 may be made by eccentric sleeve turning. One of the sonde housing 22 and bent sub 26 is turned first, and then the angle of turning is altered to form the remainder of the one piece construction. As should be understood by those of ordinary skill in the art, however, other materials and manufacturing methods may be used as well.

The bent sub 26 is formed so that a central axis A (FIG. 1), extending longitudinally through the drill bit 18 and the casing 16, intersects a central axis B (FIG. 1), extending longitudinally through the sonde housing 22 at a non-zero angle $\alpha$. As described above, the non-zero angle $\alpha$ created by the bent sub 26 allows the operator to steer the drill bit 18 and casing 16 around obstacles in the drilling path and approach set exit locations. The non-zero angle $\alpha$ is generally between about 1° and about 2°, such as, for example, about 1.5°. However, other non-zero angles $\alpha$ may be used as well in keeping with the invention.

The bent sub 26 optionally also includes at least one buffer 48 protruding from an exterior surface thereof. The buffer 48 is preferably formed from a carbide or other high-strength, rugged material and is used to prevent excessive wear on the bent sub 26. The at least one buffer 48 may be provided in one or more corresponding grooves 50 formed in the exterior surface of the bent sub 26 and may be attached by the use of adhesives, positive fit, welding, or the like.

Turning back to the sonde housing 22, the sonde housing 22 includes a battery operated sonde 30 disposed therein (FIG. 4), comprising a battery and electronic components (not shown) of the drill 10, as is conventionally known. As shown best in FIGS. 3 and 4, the sonde 30 is located in a generally enclosed sonde compartment 54 formed in the sonde housing 22. The sonde compartment 54 is preferably coaxially disposed within the sonde housing 22. As shown best in FIG. 4, the sonde compartment 54 is sized and dimensioned to substantially fittingly receive the sonde 30, i.e., the size and shape of the compartment 54 generally complements the size and shape of the sonde 30, to secure the sonde 30 therein and provide protection to the electronic components inside the sonde 30 from the pressure and impact effects of the drilling operation.

Figure 3:
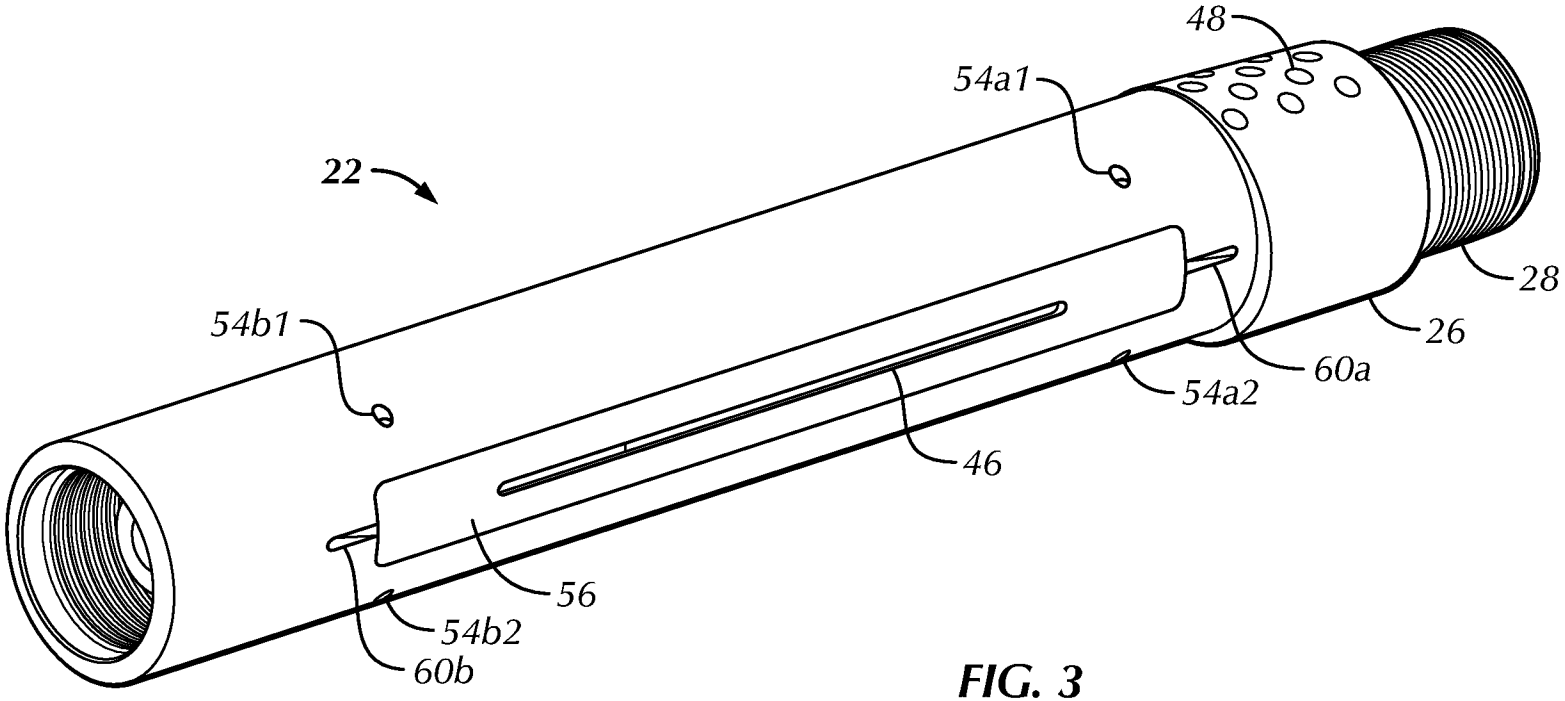
FIG. 3 is a right side perspective view of the sonde housing and bent sub of the fluid-actuated directional percussive impact tool of FIG. 1.
Figure 4:
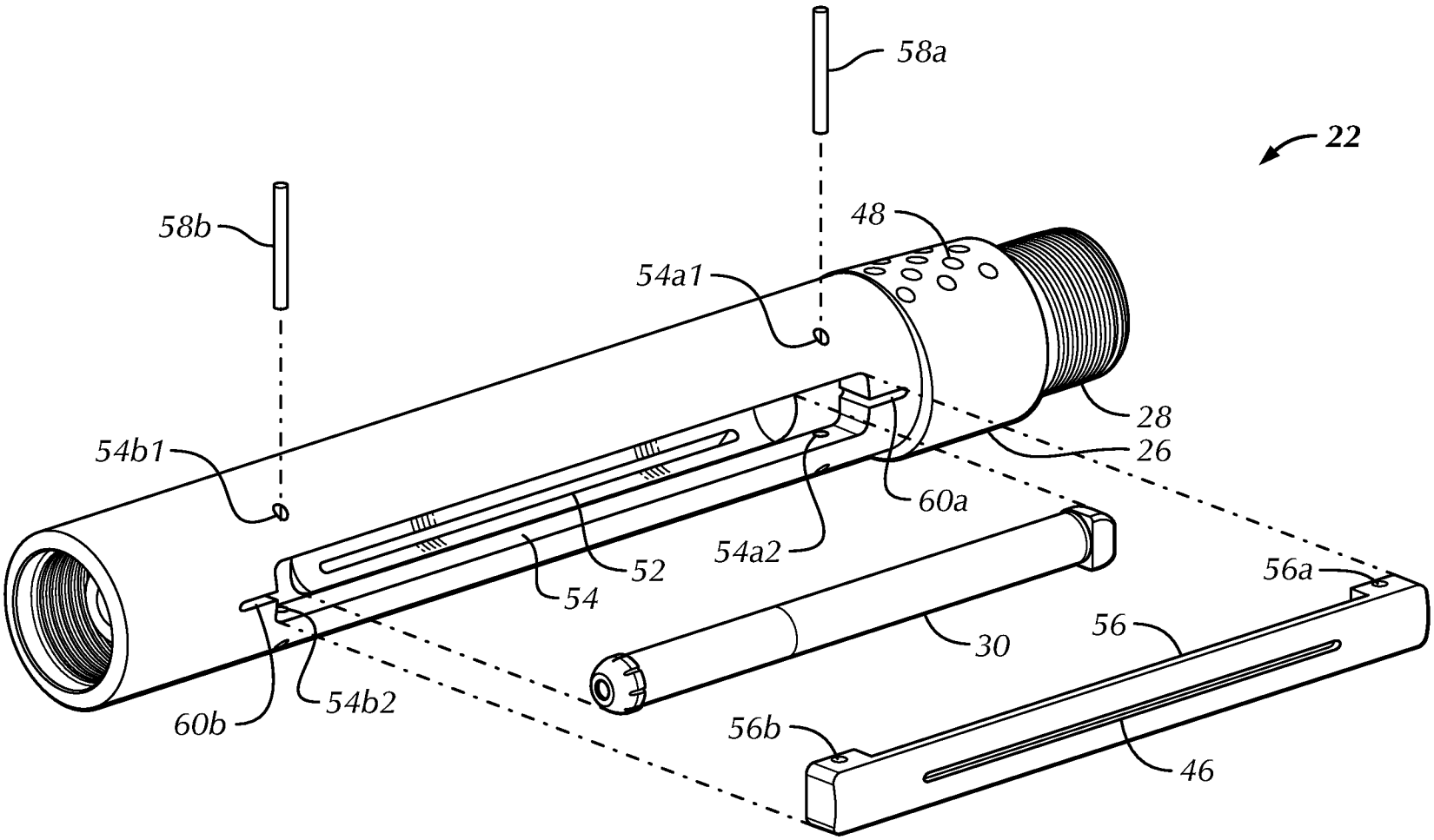
FIG. 4 is a right side exploded view of the sonde housing and bent sub of the fluid-actuated directional percussive impact tool of FIG. 1.

The sonde compartment 54 defines an open side along the exterior (peripheral) surface of the sonde housing 22 for receiving the sonde 30 therethrough. A cover 56, generally complementary in size and shape to the open side of the sonde compartment 54 to mate therewith, is removably mounted thereon and extends generally flush with the exterior surface of the sonde housing 22 when mounted (FIG. 3). The sonde compartment 54 includes at least one pair of laterally opposed bored apertures **54*a*1, 54*a*2 in respectively opposing sides of the compartment 54 and in registry with one another. That is, the bored apertures 54*a*1, 54*a*2 are linearly aligned along an axis generally perpendicular to the central axis B of the sonde housing 22. In the illustrated embodiment, the sonde compartment 54 also includes a second pair of laterally opposed bored apertures 54*b*1, 54*b*2 in respectively opposing sides of the compartment 54** and in registry with one another.

Correspondingly, the cover 56 includes at least a first bored channel **56*a* positioned to be in registry, i.e. aligned, with the first pair of bored apertures 54*a*1, 54*a*2 when the cover 56 is mounted upon the sonde compartment 54. In the illustrated embodiment, the cover 56 also includes a second bored channel 56*b* positioned to be in registry with the second pair of bored apertures 54*b*1, 54*b*2 when the cover 56 is mounted upon the sonde compartment 54. To secure the cover 56 in the mounted position, a first pin 58*a* is advanced through the bored aperture 54*a*1, the first bored channel 56*a* and the bored aperture 54*a*2. Similarly, a second pin 58*b* is advanced through the bored aperture 54*b*1, the second bored channel 56*b* and the bored aperture 54*b*2**.

When the sonde 30 requires battery replacement, the pins **58*a*, 58*b* are driven out of their respective bored apertures 54*a*1, 54*a*2; 54*b*1, 54*b*2 and bored channels 56*a*, 56*b* such that the cover 56 may be dismounted/removed. A first groove 60*a* is formed in the exterior surface of the sonde housing 22, extending forwardly from one end of the sonde compartment 54 and a second groove 60*b* is formed in the exterior surface of the sonde housing 22, extending rearwardly from a second end of the sonde compartment 54 to provide leverage for accessing and removing the cover 56**.

After cover 56 removal, the sonde 30 is directly accessible for removal from the compartment 54 to replace the battery thereof. Alternatively, the entire sonde 30 may be replaced in the event of malfunction. After the sonde battery is replaced and the sonde 30 is re-inserted back into the sonde compartment 54, the cover 56 is re-mounted back upon the sonde compartment 54 and the pins 58*a*, 58*b* re-advanced back through their respective bored apertures 54*a*1, 54*a*2; 54*b*1, 54*b*2 and bored channels 56*a*, 56*b*. As should be understood by those of ordinary skill in the art, however, the cover 56 may be removably secured upon the sonde compartment 54 in any of numerous ways currently known, or that later become known, to permit the direct access to the sonde 30 described herein.

The sonde housing 22 also includes at least one longitudinally extending slot 46 formed along the exterior surface thereof. The slot 46 is provided to allow radio waves generated by the sonde 30 to emerge unimpeded from the sonde housing 22. The radio waves are utilized to, among other things, track the location and orientation of the drill 10. Preferably the angle of the drill bit 18 is timed to the orientation of the slot 46 to increase the accuracy of position and orientation detection. In the illustrated embodiment, the cover 56 includes the slot 46. As shown best in FIGS. 2 and 4, the sonde compartment 54 also includes at least one longitudinally extending slot 52 (two slots 52 in the illustrated embodiment of FIG. 2) formed along the interior surface thereof, to further minimize radio wave obstruction to and from the sonde 30.

From the foregoing, it can be seen that embodiments of the present invention comprise fluid-actuated directional drilling equipment. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sonde housing for a fluid-actuated percussive impact tool, the sonde housing comprising:

a sonde compartment formed in the sonde housing and defining an open side along an exterior side surface of the sonde housing, a sonde removably secured in the sonde compartment, and a cover removably mounted upon the open side of the sonde compartment to close the open side thereof, wherein:

the sonde compartment includes a first bored aperture in one side of the sonde compartment and a second bored aperture in an opposing side of the sonde compartment, the first bored aperture and the second bored aperture being in registry with one another;

the cover includes a bored channel therein, the bored channel being in registry with the first bored aperture and the second bored aperture when the cover is mounted upon the sonde compartment; and the sonde housing further comprises a pin extending through the first bored aperture, the bored channel and the second bored aperture to secure the cover upon the sonde compartment, the pin being removable from the first bored aperture, the bored channel and the second bored aperture to dismount the cover from the sonde compartment.

2. The sonde housing of claim 1, further comprising a first groove formed in the exterior side surface of the sonde housing and extending from one end of the sonde compartment to provide leverage for removing the cover.

3. A fluid-actuated percussive impact tool comprising:

a back head for connection to a pressurized fluid source;

a tool casing housing a drill bit longitudinally movable with respect thereto;

the sonde housing of claim 1, coupled between the back head and the tool casing; and a sub connecting the sonde housing to the tool casing.

4. The fluid-actuated percussive impact tool of claim 3, wherein the drill bit defines a central axis extending longitudinally therethrough and the sonde housing defines a central axis extending longitudinally therethrough, and the sub is a bent sub such that the central axis of the drill bit intersects the central axis of the sonde housing at a non-zero angle.

5. The fluid-actuated percussive impact tool of claim 4, wherein the angle is between about 1° and about 2°.

6. The fluid-actuated percussive impact tool of claim 5, wherein the angle is about 1.5 degrees.

7. The fluid-actuated percussive impact tool of claim 4, wherein the sub is integrally formed with the sonde housing.

8. The fluid-actuated percussive impact tool of claim 7, wherein the sonde housing and the bent sub are formed from a single piece of turned steel.

9. The fluid-actuated percussive impact tool of claim 3, wherein the sub is integrally formed with the sonde housing.

10. The fluid-actuated percussive impact tool of claim 9, wherein the sonde housing and the bent sub are formed from a single piece of turned steel.

11. A fluid-actuated percussive impact tool comprising:

a back head for connection to a pressurized fluid source;

a tool casing housing a drill bit longitudinally movable with respect thereto, the drill bit defining a central axis extending longitudinally therethrough;

a sonde housing coupled between the back head and the tool casing and defining a central axis extending longitudinally through the sonde housing, the sonde housing comprising:

a sonde compartment formed in the sonde housing and defining an open side along an exterior side surface of the sonde housing, a sonde removably secured in the sonde compartment, and a cover removably mounted upon the open side of the sonde compartment to close the open side thereof, wherein:

the sonde compartment includes a first bored aperture in one side of the sonde compartment and a second bored aperture in an opposing side of the sonde compartment, the first bored aperture and the second bored aperture being in registry with one another;

the cover includes a bored channel therein, the bored channel being in registry with the first bored aperture and the second bored aperture when the cover is mounted upon the sonde compartment; and the sonde housing further comprises a pin extending through the first bored aperture, the bored channel and the second bored aperture to secure the cover upon the sonde compartment, the pin being removable from the first bored aperture, the bored channel and the second bored aperture to dismount the cover from the sonde compartment; and a bent sub integrally formed with the sonde housing and connecting the sonde housing to the tool casing, such that the central axis of the drill bit intersects the central axis of the sonde housing at a non-zero angle.

12. The fluid-actuated percussive impact tool of claim 11, wherein a first groove is formed in the exterior side surface of the sonde housing and extends from one end of the sonde compartment to provide leverage for removing the cover.

* * * * *